US008487170B2

(12) United States Patent
Klein

(10) Patent No.: US 8,487,170 B2
(45) Date of Patent: Jul. 16, 2013

(54) PERCUSSION INSTRUMENT

(76) Inventor: Pascal Klein, Leutenheim (FR)

( * ) Notice: Subject to any disclaimer, the term of this patent is extended or adjusted under 35 U.S.C. 154(b) by 2 days.

(21) Appl. No.: 13/256,103

(22) PCT Filed: Mar. 2, 2010

(86) PCT No.: PCT/FR2010/000183

§ 371 (c)(1),
(2), (4) Date: Sep. 12, 2011

(87) PCT Pub. No.: WO2010/103199

PCT Pub. Date: Sep. 16, 2010

(65) Prior Publication Data

US 2012/0000342 A1 Jan. 5, 2012

(30) Foreign Application Priority Data

Mar. 13, 2009 (FR) ..... 09 01165

(51) Int. Cl.
*G10D 13/02* (2006.01)

(52) U.S. Cl.
USPC ..... 84/411 R

(58) Field of Classification Search
USPC ..... 84/411 R
See application file for complete search history.

(56) References Cited

U.S. PATENT DOCUMENTS

| | | | | |
|---|---|---|---|---|
| 478,611 | A * | 7/1892 | Knittel | 84/416 |
| 1,291,903 | A * | 1/1919 | Isham | 84/269 |
| 5,385,075 | A * | 1/1995 | Carnes et al. | 84/411 R |
| 7,692,083 | B2 * | 4/2010 | Aspland | 84/415 |
| 7,816,596 | B2 * | 10/2010 | Bottger | 84/411 R |
| 8,008,560 | B2 * | 8/2011 | Wiese et al. | 84/411 R |
| 8,115,088 | B2 * | 2/2012 | Herrera | 84/411 R |
| 2008/0034944 | A1 * | 2/2008 | Aspland | 84/415 |

(Continued)

FOREIGN PATENT DOCUMENTS

| | | | |
|---|---|---|---|
| DE | 20 2005 020022 | U1 | 2/2006 |
| DE | 20 2007 000686 | U1 | 5/2007 |
| DE | 10 2007 032204 | B3 | 10/2008 |
| GB | 2 334 366 | A | 8/1999 |

OTHER PUBLICATIONS

Boombakini by Felle Vega, uploaded on Mar. 7, 2007, viewed at http://www.youtube.com/watch?v=MscN4Xc-lEU on Nov. 13, 2012.*

(Continued)

*Primary Examiner* — David Warren
*Assistant Examiner* — Robert W Horn
(74) *Attorney, Agent, or Firm* — McGlew & Tuttle, P.C.

(57) ABSTRACT

The present invention relates to a percussion instrument of the type consisting of a box composed of four walls (1) forming the outline, on which a top (2) rests, the lateral end walls (3-4) having a rectangular profile, the front (5) and rear (6) faces having a convex profile (7) in their lower part while in their upper part on which the top rests they follow a line which is firstly rectilinear (8), then continued by a concave part (9), which is itself continued by a rectilinear or very slightly convex part (10), such that the box is divided into three zones: a deep zone (8) for producing bass sounds, continued by a shallower median part (9) for producing middle register sounds, said median part itself being continued in such a way as to form a chamber (10) which is slightly deeper than the median part for producing high pitched sounds, the chamber (10) producing the high pitched sounds being provided with a snare (17) lying against the top.

6 Claims, 4 Drawing Sheets

U.S. PATENT DOCUMENTS

| | | | | |
|---|---|---|---|---|
| 2008/0083317 | A1* | 4/2008 | Payerl | 84/411 R |
| 2008/0110321 | A1* | 5/2008 | Wening | 84/421 |
| 2009/0013849 | A1* | 1/2009 | Payerl | 84/411 R |
| 2009/0158914 | A1* | 6/2009 | Boettger | 84/421 |
| 2010/0050852 | A1* | 3/2010 | Aspland | 84/415 |
| 2012/0000342 | A1* | 1/2012 | Klein | 84/415 |
| 2012/0073420 | A1* | 3/2012 | Schmader | 84/415 |

OTHER PUBLICATIONS

Ocana, German, "How to Build Flamenco Cajon with Plywood," © 2004.*

History of the Cajon, viewed Mar. 13, 2008 at http://www.cajondg.com/en/products/history.html.*

* cited by examiner

PERCUSSION INSTRUMENT

The invention relates to a percussion instrument. Instruments of the same family are the cajón from Peru and the Boombakini from the Dominican Republic.

The cajón consists of a parallelepipedal wooden box with a hole at the back. This instrument stands directly on the ground with the musician sitting on it. The cajón is provided with a snare system formed of one or more metal wires. These metal wires are fixed to upper and lower parts of the box, crossing the latter and pressing against the striking surface. This wire may be straight or in a more expensive cajón it may take the form of a spiral.

The drawback of the cajón is that it has a limited range of sounds owing to its parallelepipedal shape. Furthermore, whichever part is struck, the snare vibrates. The cajón is not very comfortable to use because the musician strikes at a low level, which may cause back pain.

The Boombakini is a wooden instrument of a particular shape. It consists of a bottomless box. This box is composed of four faces forming the outline, on which a top rests. The lateral end walls have a rectangular profile. The front and rear faces have a convex profile in their lower part whilst in their upper part they follow a line which is firstly rectilinear, then continued by a concave part, which is itself continued by a rectilinear or very slightly convex part. The box may thus be divided into three zones: a deep zone for producing bass sounds, continued by a shallower median part for producing middle register sounds, said median part itself being continued in such a way as to form a chamber which is slightly deeper than the median part for producing high pitched sounds. A soundhole is arranged in the front face of the box. Although the Boombakini has a wider range of tones than the cajón, it has the drawback of having no snare. The bass sounds are dry and not round like those of a bass drum. Likewise the slap sound located at the slender high part cannot compare with a snare drum.

The device according to the invention makes it possible to remedy the drawbacks mentioned above.

Taking its inspiration from the shape of the Boombakini, a snare system has been added using two ferrous wires in the form of stretched-out springs which cross one another. This system is fixed in the slender, high pitched zone, on either side of the width thereof, and cross in the middle. This crossed system makes it possible to aim for the point on the striking surface where the impact will activate the snare. These wires are fixed so as to touch the cover of the box where it is struck and stay lying thereagainst. In this way, when the player strikes the deep part of the instrument to produce a low sound, the snare does not vibrate.

The deeper part then emits a sound similar to the bass drum and the slender part will emit a sound similar to the snare drum with vibration of the snare. To give intensity and body to the sounds, a bottom was arranged over the entire lower part of the underside, closing the instrument entirely.

This bottom comprises one to two holes depending on the desired bass compression. This bottom is fixed to the box with the assistance of a plurality of reinforcements on the frame parts in the interior thereof. The entire box is made of wood.

The invention will in any event be better understood from the remainder of the description below and the appended figures.

Figure 1:
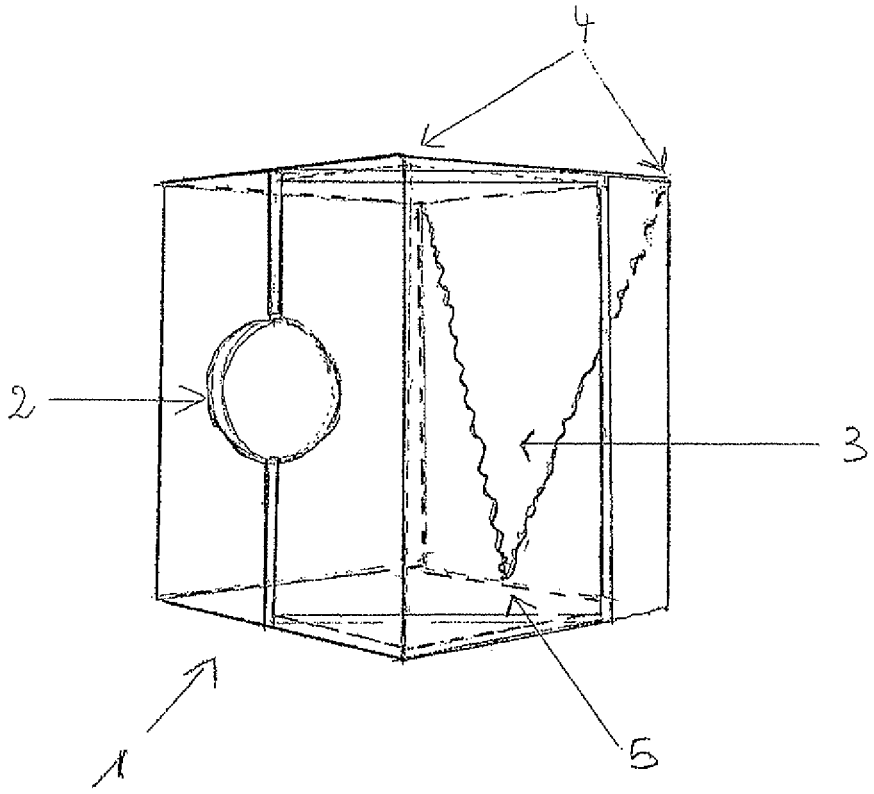
FIG. 1 shows an overall view of a cajón

As shown in FIG. 1, a cajón consists of a parallelepipedal wooden box (1) provided with a hole (2) in the back. This instrument stands directly on the ground with the musician sitting on it. The cajón is provided with a snare system formed of one or more metal wires (3). The upper part of these metal wires is fixed to the top of the front face (4) and the lower part in the middle (5) of the edge of said front face such that they cross over the latter while pressing against the striking surface. This wire may be straight or in a more expensive cajón it may take the form of a spiral.

Figure 2:
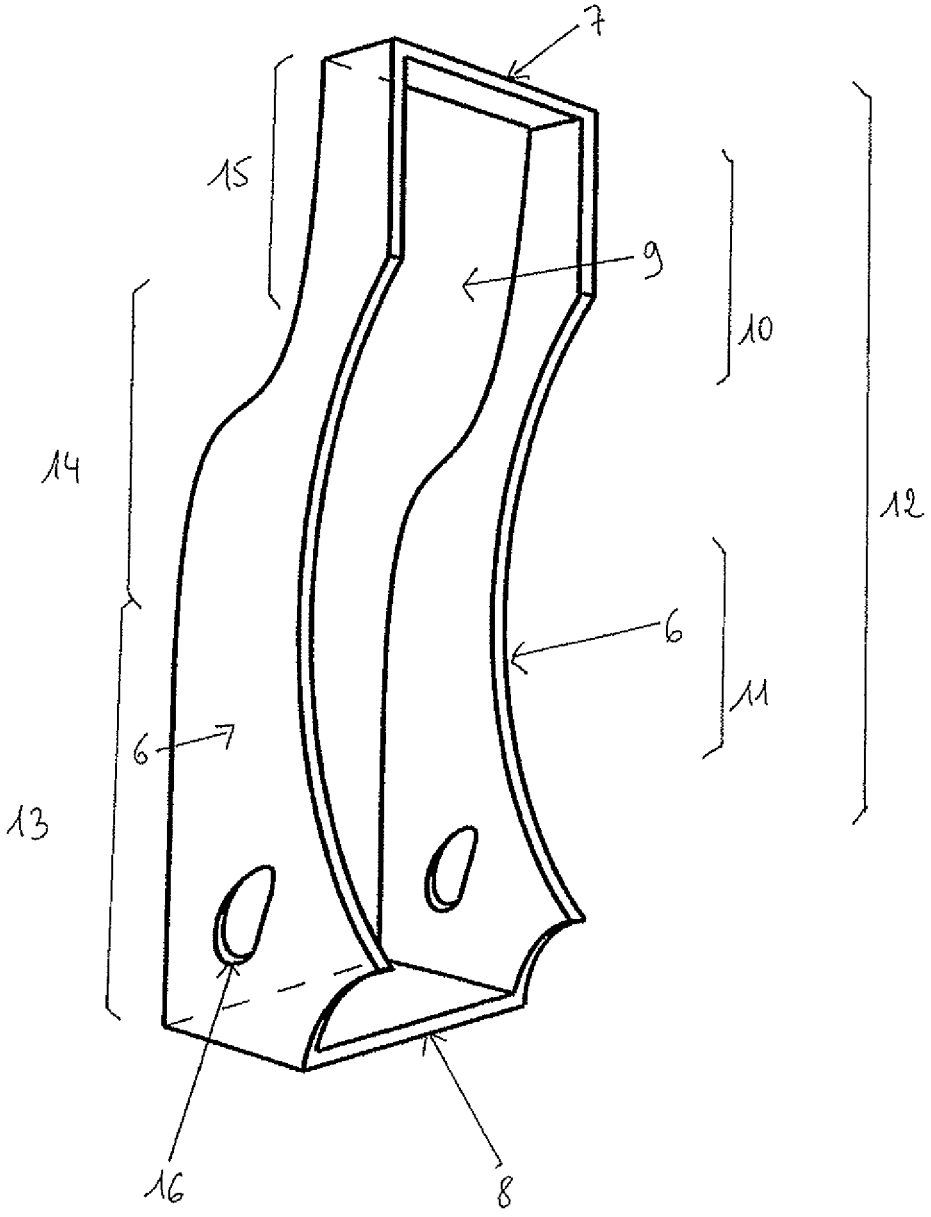
FIG. 2 shows an overall view of a Boombakini
Figure 3:
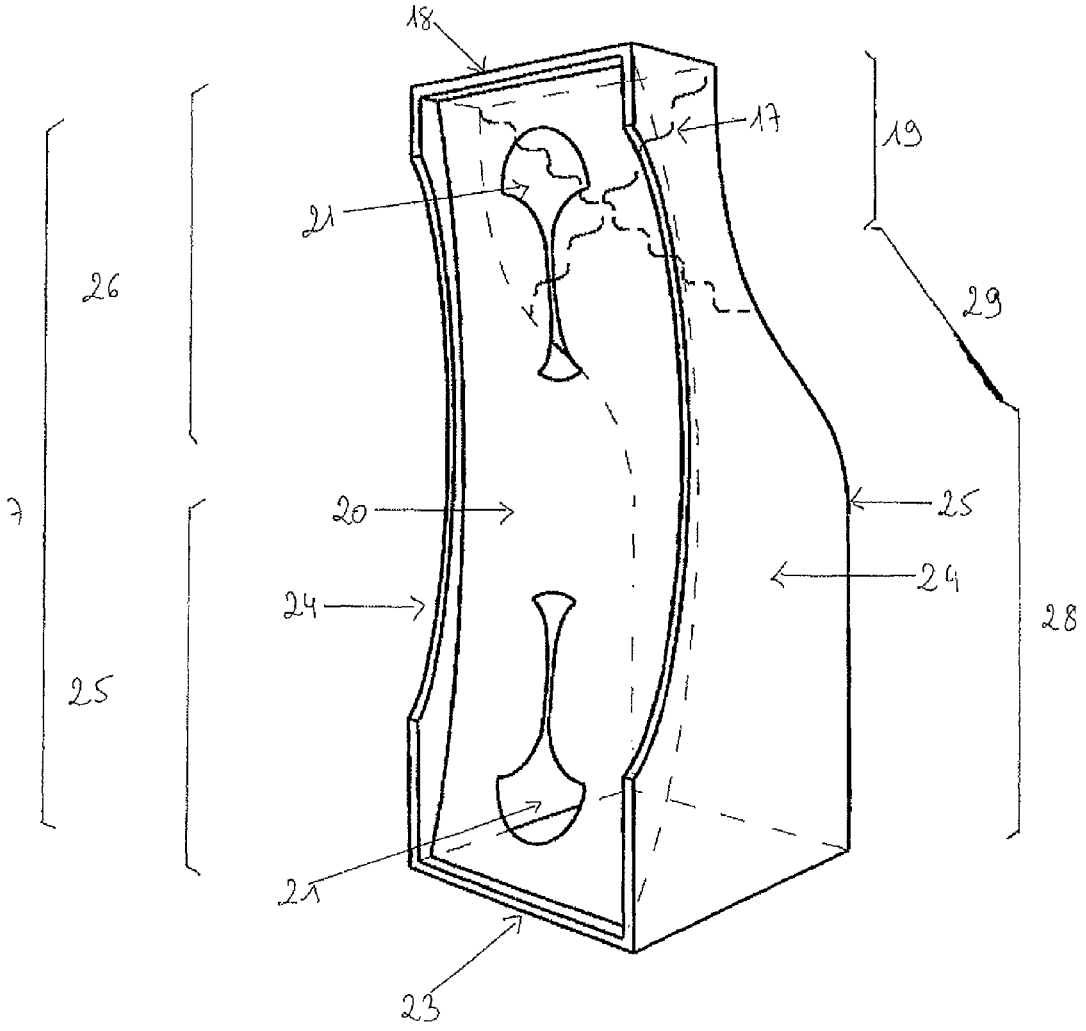
FIG. 3 shows an overall view of the invention to which the present patent relates
Figure 4:
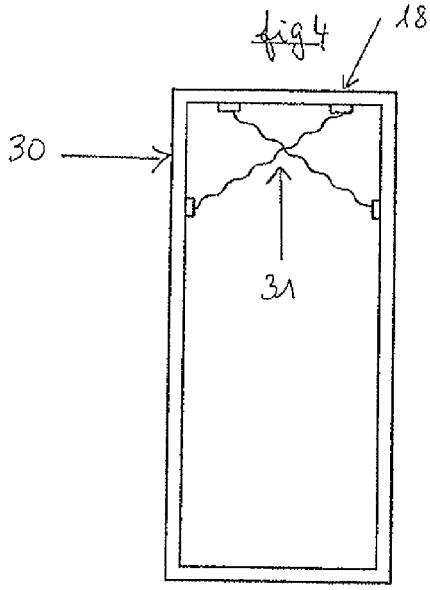
FIG. 4 shows the arrangement of the crossed stretched-out spring wires (snare) with fastening points
Figure 5:
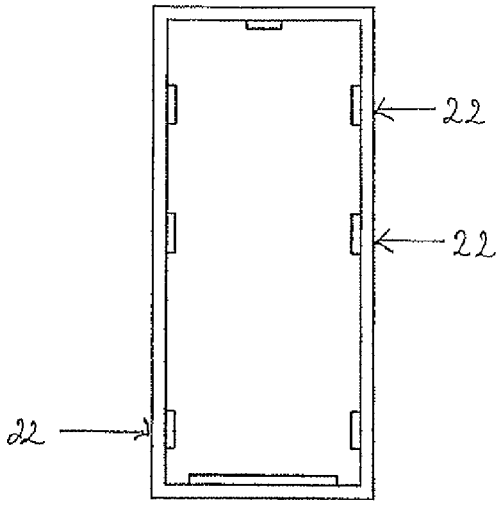
FIG. 5 shows the arrangement of the reinforcements inside the box
Figure 6:
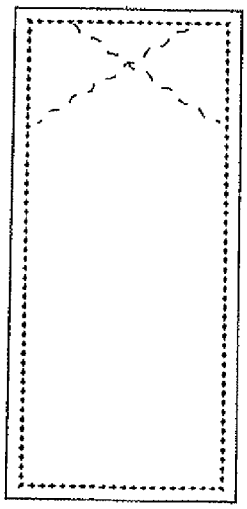
FIG. 6 shows the cover where the player strikes
Figure 7:
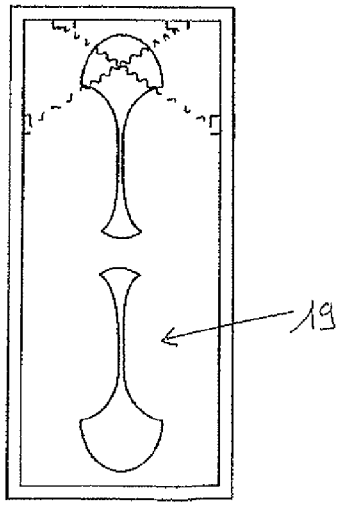
FIG. 7 shows the bottom with soundholes.

As shown in FIG. 2, a Boombakini consists of a bottomless box. This box is composed of four faces (6, 7 and 8) forming the outline, on which a top (9) rests. The lateral end walls (7 and 8) have a rectangular profile. The front (10) and rear (11) have a convex profile (12) in their lower part whilst in their upper part they follow a line which is firstly rectilinear (13), then continued by a concave part (14), which is itself continued by a rectilinear or very slightly convex part (15). The box may thus be divided into three zones: a deep zone (13) for producing bass sounds, continued by a shallower median part (14) for producing middle register sounds, said median part itself being continued in such a way as to form a chamber (15) which is slightly deeper than the median part for producing high pitched sounds. A soundhole (16) is arranged in the front face of the box.

As shown in FIGS. 3 to 7, the instrument to which the present patent relates takes its inspiration from the shape of the Boombakini. A snare has been added which consists of two metal wires (17) in the form of stretched-out springs which cross one another. This snare is fixed in the slender high pitched zone. This crossed snare makes it possible to aim for the point on the striking surface where the impact will activate the snare. These wires in the form of springs are fixed on the one hand to the end wall (18) closing the chamber (19) and on the other hand to the front and rear faces at the entry to the chamber (19) such that they touch the top of the box where it is struck and stay lying against said top. In this way, when the player strikes on the deep part of the instrument to produce a low sound, the snare does not vibrate. The deeper part then emits a sound similar to the bass drum and the slender part will emit a sound similar to the snare drum with vibration of the snare. To give intensity and body to the sounds, a bottom (20) has been arranged over the entire lower part of the underside, closing the instrument entirely. This bottom comprises one to two soundholes (21) depending on the desired bass compression. This bottom is fixed to the box with the assistance of a plurality of reinforcements (22) on the peripheral frame parts in the interior thereof. The entire box is made of wood.

The invention claimed is:

1. A musical instrument, comprising:

a box composed of four walls forming the outline, on which a top rests, the lateral end walls having a rectangular profile, the front and rear faces having a convex profile in their lower part whilst in their upper part on which the top rests they follow a line which is firstly rectilinear, then continued by a concave part, which is itself continued by a rectilinear or very slightly convex part, such that the box is divided into three zones: a deep zone for producing bass sounds, continued by a shallower median part for producing middle register sounds, said median part itself being continued in such a way as to form a chamber which is slightly deeper than the median part for producing high pitched sounds, said chamber producing the high pitched sounds being provided with a snare lying against the top, wherein the snare comprises two crossed metal wires and, said wires being fixed on the one hand to the end wall closing the chamber and on the other hand to the front and rear faces at the entry to the chamber.

2. A musical instrument according to claim 1, wherein said two crossed metal wires are two crossed metal springs.

3. A musical instrument according to claim 1, wherein a bottom rests, in the lower part of convex profile of the front and rear faces, on reinforcements arranged around the internal periphery of the frame.

4. A musical instrument according to claim 3, wherein the bottom is provided with soundholes.

5. A musical instrument according to claim 2, wherein a bottom rests, in the lower part of convex profile of the front and rear faces, on reinforcements arranged around the internal periphery of the frame.

6. A musical instrument according to claim 5, wherein the bottom is provided with soundholes.

* * * * *